US011167401B2

(12) United States Patent
Osborne et al.

(10) Patent No.: US 11,167,401 B2
(45) Date of Patent: Nov. 9, 2021

(54) PANEL INSERT REMOVAL TOOL AND METHOD

(71) Applicant: The Boeing Company, Chicago, IL (US)

(72) Inventors: John C. Osborne, Bothell, WA (US); Terrence C. Seet, Mill Creek, WA (US); David G. Pease, Lacey, WA (US); Paul M. Etzkorn, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 160 days.

(21) Appl. No.: 16/747,379

(22) Filed: Jan. 20, 2020

(65) Prior Publication Data

US 2021/0220979 A1 Jul. 22, 2021

(51) Int. Cl.
*B25B 27/14* (2006.01)

(52) U.S. Cl.
CPC ..... *B25B 27/14* (2013.01)

(58) Field of Classification Search
CPC ..... B25B 27/00; B25B 27/02; B25B 27/023; B25B 27/14; Y10T 29/53683; Y10T 29/53796; Y10T 29/53848; Y10T 29/53857; Y10T 29/53878; Y10T 29/53891; B23P 19/02; B23P 19/025; B23P 19/04; H05B 2203/03; H05B 6/14; H05B 3/20
USPC ..... 29/244, 426.5, 426.6, 255, 252, 278; 219/221, 227, 228, 229, 230
See application file for complete search history.

(56) References Cited

U.S. PATENT DOCUMENTS 1,544,246 A * 6/1925 Leslie ..... B25B 27/06 29/255
9,782,877 B2 * 10/2017 Marquis ..... B25B 27/02

* cited by examiner

*Primary Examiner* — Lee D Wilson
*Assistant Examiner* — Alberto Saenz
(74) *Attorney, Agent, or Firm* — Duft & Bornsen, PC

(57) ABSTRACT

Removal tool and method for removing a panel insert from a panel. In one embodiment, the removal tool includes a tool frame to straddle a panel insert installed in a panel, and a puller rod slidably disposed perpendicularly through the tool frame. One end of the puller rod engages the panel insert. The removal tool further includes a biasing member that applies an axial force to the puller rod away from the tool frame, and a heater to apply heat to the panel insert.

20 Claims, 12 Drawing Sheets

PANEL INSERT REMOVAL TOOL AND METHOD

FIELD

This disclosure relates to the field of tools, and more particularly, to tools that remove panel inserts from panels.

BACKGROUND

Panels are used in a variety of applications as structural elements. When fastening a panel to another element, holes may be drilled or otherwise formed through the panel for a fastener or the like. Depending on the type of material used for the panel, it may be undesirable to install the fastener directly in the holes of the panel. Thus, panel inserts may be installed in the holes of the panel. One type of panel insert is a one-sided panel insert that includes a bushing that is inserted in a hole of the panel, and a flange on one end of the bushing that engages one side of the panel. The other end of the bushing may be flush with the other side of the panel, may be recessed in the hole, may project from the hole, etc. A one-sided panel insert also includes a thru-hole (threaded or non-threaded) for a fastener that is used to secure the panel to another element. A one-sided panel insert is typically bonded to the panel with an adhesive on the flange and/or bushing.

After installation, there may be a need to remove a panel insert from the panel, such as when the panel insert becomes corroded, damaged, or the like. However, it may be difficult to remove the panel insert without causing damage to the panel.

SUMMARY

Provided herein is a removal tool that is configured to extract a panel insert from a panel. A removal tool as described herein is placed on one side of the panel to straddle the panel insert, and a puller rod is coupled to the panel insert. A biasing member of the removal tool applies an axial force to the puller rod as a heater applies heat to the panel insert to soften the adhesive. When the adhesive becomes sufficiently soft, the axial force on the puller rod causes the panel insert to pop out of the hole in the panel. The removal tool provides a technical benefit in that the panel insert may be effectively removed without damage to the panel. Also, processes of using the removal tool are repeatable by operators without need for specialized skills.

One embodiment comprises a removal tool configured to remove a panel insert installed in a panel. The removal tool comprises a tool frame to straddle the panel insert, and a puller rod slidably disposed through the tool frame perpendicularly to a bottom surface of the tool frame that contacts the panel. The puller rod has a first end to engage the panel insert. The removal tool further comprises a biasing member that applies an axial force to the puller rod away from the tool frame, and a heater to apply heat to the panel insert.

In another embodiment, the biasing member is disposed between the tool frame and a second end of the puller rod.

In another embodiment, the removal tool further comprises a loading member that preloads the biasing member by a predetermined amount.

In another embodiment, the heater includes one or more heating elements, and a temperature sensor that measures a temperature.

In another embodiment, the removal tool further comprises a heater controller electrically coupled to the heating elements and the temperature sensor. The heater controller selectively applies power to the heating elements based on the temperature output by the temperature sensor.

Another embodiment comprises a removal tool configured to remove a panel insert installed in a panel. The removal tool comprises a tool frame that supports the removal tool on a side of a panel, and straddles the panel insert. The removal tool further comprises a puller rod that extends through a guide opening in the tool frame and is slidable axially in relation to the tool frame. The puller rod has a first end to couple with the panel insert. The removal tool further comprises a housing having a rod opening coaxial with the guide opening in the tool frame. The puller rod extends through the rod opening, and the housing is coupled to the puller rod toward a second end of the puller rod. The removal tool further comprises a spring disposed between the tool frame and the housing that applies an axial force against the housing, and a heater to apply heat to the panel insert.

In another embodiment, the tool frame includes a base member defining a bottom surface of the tool frame that contacts the side of the panel, and having an insert opening to encircle the panel insert. The tool frame further includes a seat member having the guide opening of the tool frame that is coaxial with the insert opening of the base member. The tool frame further includes a plurality of legs disposed between the base member and the seat member. The puller rod passes through the insert opening and the guide opening. The seat member holds a first end of the spring.

In another embodiment, the housing includes a hollow, cylindrical body comprising an end wall having the rod opening coaxial with the guide opening of the seat member, and a plurality of side walls that project from the end wall with gaps separating the side walls. An inner surface of the end wall holds a second end of the spring.

In another embodiment, the legs of the tool frame are spaced radially around the insert opening of the base member, and the side walls of the housing are disposed between the legs when the spring is compressed.

In another embodiment, the removal tool further comprises a stopper that stops axial movement of the housing away from the tool frame due to the axial force from the spring after traveling a threshold distance.

In another embodiment, when the spring is compressed, a bottom portion of a pair of the side walls extend below the seat member of the tool frame. The stopper includes a securing pin inserted through coaxial holes in the bottom portion of the pair of the side walls.

In another embodiment, the heater includes a heater body having a rod opening, with the puller rod passing through the rod opening. The heater further includes one or more heating elements, and a temperature sensor that measures a temperature of the heater body.

In another embodiment, an outer diameter of the heater body is equal to or greater than a diameter of the panel insert.

In another embodiment, the removal tool further comprises a heater controller electrically coupled to the heating elements and the temperature sensor. The heater controller selectively applies power to the heating elements based on the temperature output by the temperature sensor.

In another embodiment, the puller rod comprises an elongated cylindrical shaft having a head at the first end, and threads at the second end. A diameter of the puller rod is less than a diameter of a thru-hole in the panel insert. A fastener is threaded on the second end with the housing disposed between the spring and the fastener.

In another embodiment, the puller rod comprises an elongated cylindrical shaft having a ball lock at the first end, and a cam lever at the second end. A diameter of the puller rod is less than a diameter of a thru-hole in the panel insert.

In another embodiment, the removal tool further comprises an insulation pad between the tool frame and the panel. The insulation pad includes an insert opening aligned with an insert opening of the tool frame.

In another embodiment, the removal tool further comprises an edge adapter having a top side that interfaces with a bottom surface of the tool frame, and a bottom side that includes a contact surface to rest on the panel, and a spacer block having a thickness that corresponds with a thickness of the panel. The edge adapter further includes an insert opening aligned with an insert opening of the tool frame.

Another embodiment comprises a method of extracting a panel insert from a panel. The method comprises placing a removal tool on the panel so that a tool frame of the removal tool straddles the panel insert, coupling a first end of a puller rod to the panel insert, coupling a biasing member between the tool frame and a second end of the puller rod, applying an axial force to the puller rod with the biasing member in a direction away from the panel, and applying heat to the panel insert while the axial force is applied by the biasing member to extract the panel insert from the panel.

In another embodiment, applying the heat comprises monitoring a temperature of a heater, and selectively applying power to the heater to stay within a temperature window.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, with reference to the accompanying drawings. The same reference number represents the same element or the same type of element on all drawings.

DETAILED DESCRIPTION

The figures and the following description illustrate specific exemplary embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1:
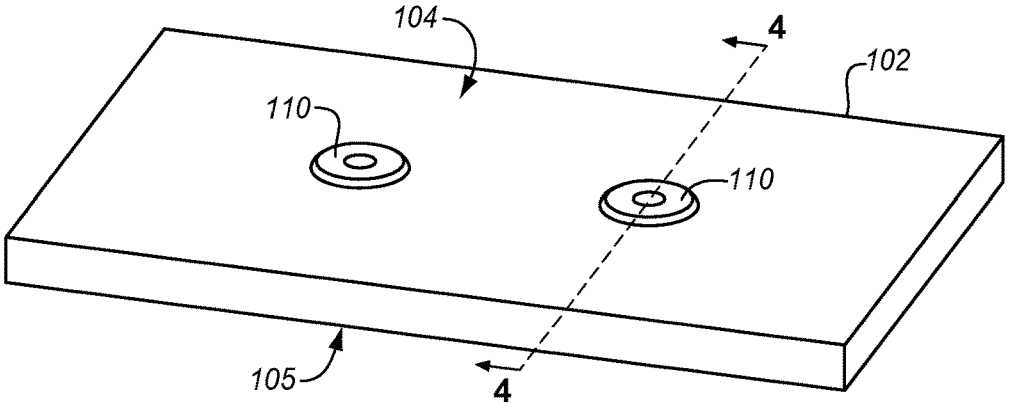
FIG. 1 is a perspective view of a panel.

FIG. 1 is a perspective view of a panel 102. Panel 102 is generally flat or planar, and may be made from metal materials, such as Titanium, Aluminum, etc., may be made from composite materials, such as a Carbon Fiber Reinforced Polymer (CFRP), Carbon Fiber Reinforced Plastic (CRP), Carbon Fiber Reinforced Thermoplastic (CFRTP), etc., or may be made from another type of material, such as fiberglass. Panel 102 may be used as a structural element for machines, such as aircraft, watercraft, automobiles, etc.

Figure 2:
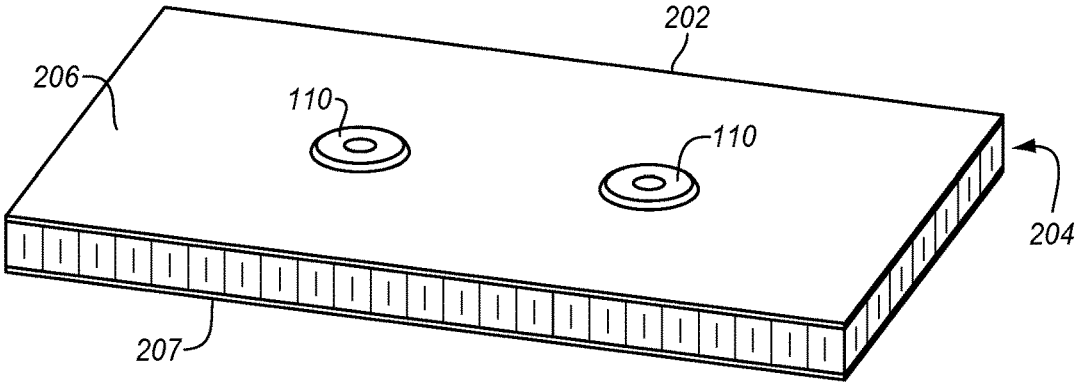
FIG. 2 is a perspective view of a honeycomb panel.

One example of a panel 102 is a honeycomb panel, which is shown in FIG. 2. Honeycomb panel 202 is comprised of a honeycomb core 204 sandwiched between face sheets 206-207. Honeycomb core 204 is a cellular structure comprised of an array of empty or hollow cells (e.g., hexagonal cells). Face sheets 206-207 are bonded to opposing sides of honeycomb core 204. Face sheets 206-207 may be solid sheets of material or perforated sheets of material that are generally flat.

Figure 3:
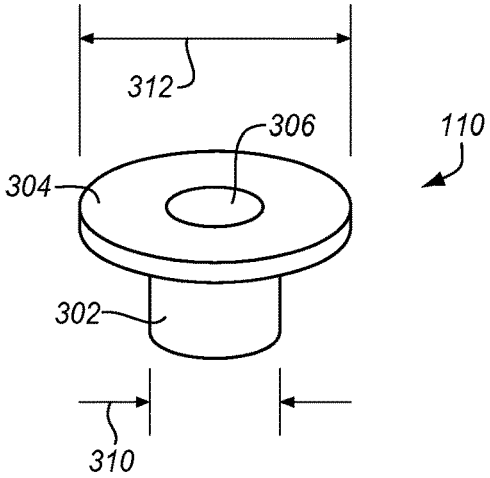
FIG. 3 is a perspective view of a panel insert.

In FIG. 1, when fastening panel 102 to another element, holes may be drilled or otherwise formed through panel 102 for a fastener or the like. To protect panel 102, a panel insert 110 may be installed in the holes of panel 102. Panel inserts 110 as described herein may be referred to as "one-sided", as panel inserts 110 are inserted into holes in panel 102 from one side (e.g., the top side 104) of panel 102. Panel inserts 110 are typically bonded to panel 102 to secure the panel inserts 110 in the holes. FIG. 3 is a perspective view of a panel insert 110. Panel insert 110 includes a bushing 302 or shaft that is inserted in a hole of panel 102, and a flange 304 on one end of the bushing 302. The outer diameter 310 of bushing 302 is sized to fit within a hole in panel 102. The outer surface of bushing 302 may have surface features, such as ribs, splines, etc., or may be smooth. Flange 304 has an outer diameter 312 that is larger than the outer diameter 310 of bushing 302 so that flange 304 contacts the top side 104 of panel 102 when panel insert 110 is pressed or otherwise inserted in panel 102. Panel insert 110 also includes a thru-hole 306 (threaded or non-threaded) for a fastener that is used to secure panel 102 to another element. FIG. 3 shows the structure of a general panel insert 110, and other types of panel inserts are considered herein.

Figure 4:
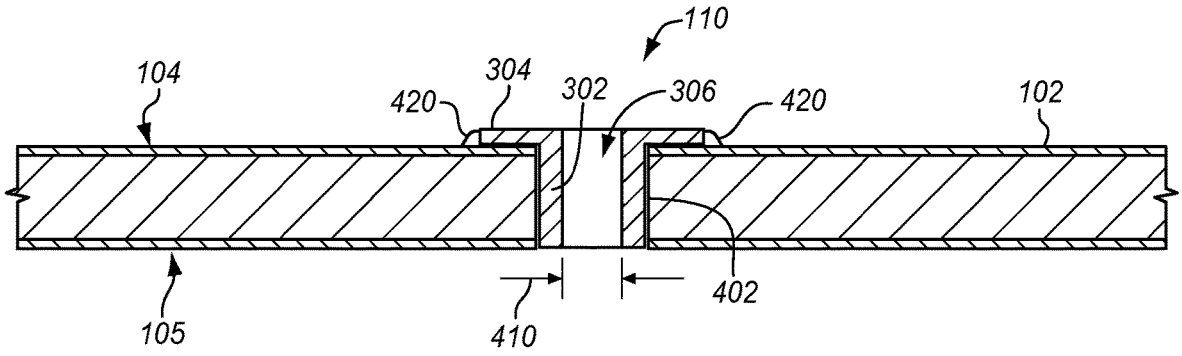
FIG. 4 is a cross-sectional view of a panel insert installed in a panel.

FIG. 4 is a cross-sectional view of panel insert 110 installed in panel 102. The view in FIG. 4 is across cut-plane 4-4 in FIG. 1. Panel insert 110 is pressed or otherwise installed in a hole 402 of panel 102 from the top side 104. When installed, bushing 302 of panel insert 110 fits within hole 402, and flange 304 contacts the top side 104 of panel 102. The end of bushing 302 opposite flange 304 may be flush with the bottom side 105 of panel 102 as is illustrated in FIG. 4. However, this end of bushing 302 may be partially recessed into hole 402 or may project from hole 402 in other examples. The thru-hole 306 of panel insert 110 has a diameter 410 that is sized to fit a fastener or the like. Flange 304 and/or bushing 302 is bonded to panel 102 with an adhesive 420 or the like, so panel insert 110 may be referred to as a "bonded" panel insert.

After installation, there may be a need or desire to remove panel insert 110 from panel 102. For example, a panel insert 110 may become corroded or damaged such that replacement is desired. When panel insert 110 is bonded to panel 102 as is illustrated in FIG. 4, it may be difficult to extract panel insert 110 without causing damage to panel 102. For example, prior methods of extracting a panel insert 110 may include prying the panel insert 110 from the top side 104 of panel 102, which can cause damage to the top side 104. Described below is a removal tool that is configured to extract a panel insert 110 (or other types of panel inserts) from a panel 102 with less risk of damage to the panel 102.

Figure 5:
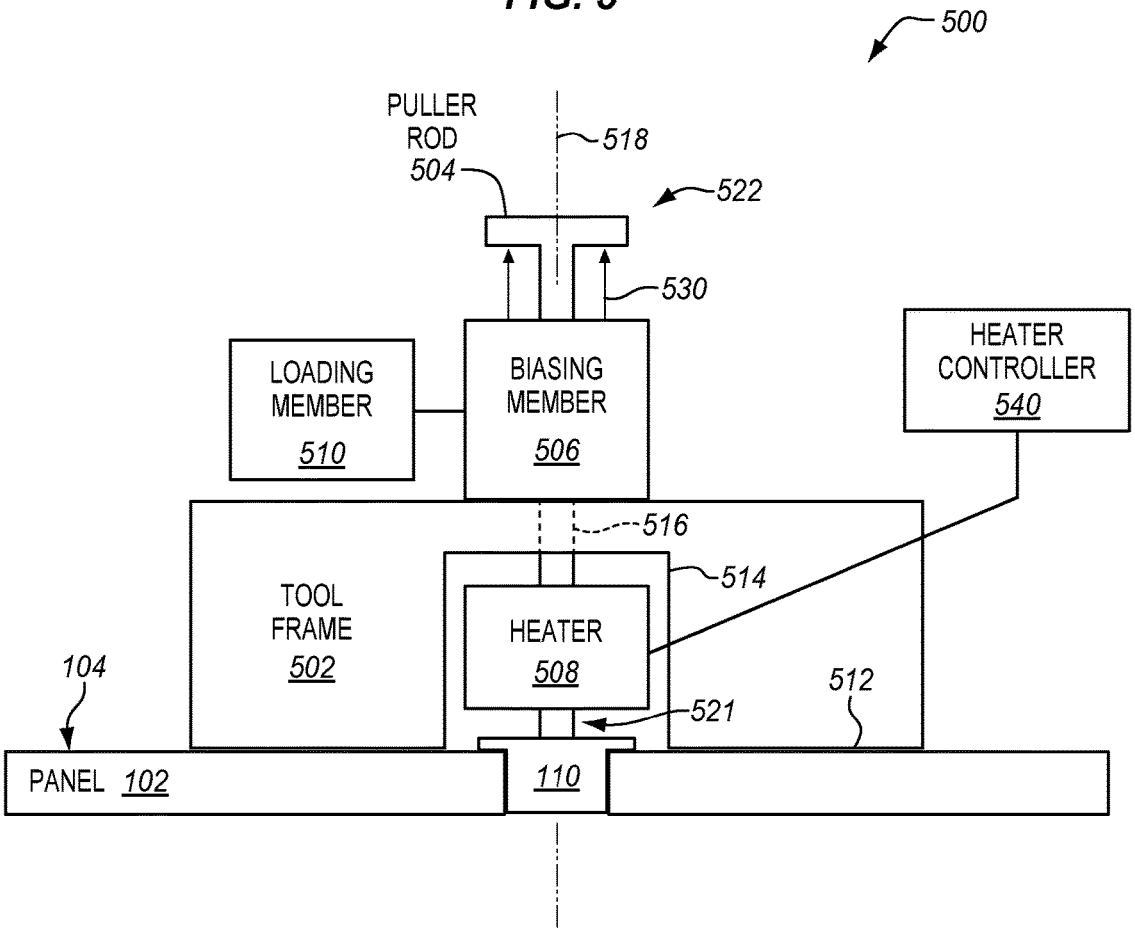
FIG. 5 is a schematic diagram of a removal tool in an illustrative embodiment.

FIG. 5 is a schematic diagram of a removal tool 500 in an illustrative embodiment. As an overview, removal tool 500 is configured to rest (directly or indirectly) on a side of a panel 102 from which a panel insert 110 is installed. For example, removal tool 500 may be placed on top side 104 of panel 102 to extract a panel insert 110. Removal tool 500 engages the panel insert 110, and applies a pulling force generally perpendicular to the panel 102. Removal tool 500 also applies heat to (or proximate to) panel insert 110 to soften or melt the adhesive 420 (see FIG. 4) that bonds panel insert 110 to panel 102. When the adhesive 420 is sufficiently softened or melted, the pulling force applied by removal tool 500 extracts panel insert 110 from the hole 402 in panel 102.

In this embodiment, removal tool 500 is an assembly that includes a tool frame 502, a puller rod 504, a biasing member 506, and a heater 508. Tool frame 502 is a structural element that supports removal tool 500 on panel 102. Tool frame 502 has a bottom surface 512 that contacts (directly or indirectly) the top side 104 of panel 102. Bottom surface 512 may be generally flat to interface with the top side 104 of panel 102, which may also be generally flat. However, bottom surface 512 may be contoured to mirror a corresponding contour on the top side 104 of panel 102. When placed on panel 102, tool frame 502 is able to straddle panel insert 110 via an insert opening 514. Insert opening 514 is a void or aperture in tool frame 502 that may be placed over a panel insert 110 so that portions of tool frame 502 contact the top side 104 of panel on multiple sides of panel insert 110. Tool frame 502 therefore extends around and encompasses panel insert 110 on top side 104. This serves to distribute any pressure or stress from tool frame 502 around the panel insert 110.

Puller rod 504 is an elongated member that is slidably disposed through a guide opening 516 in tool frame 502. Puller rod 504 is configured to move axially (up and down in FIG. 5) in relation to tool frame 502 along axis 518. Guide opening 516 is configured to direct the movement of puller rod 504 in the axial direction. One end 521 of puller rod 504 is configured to engage panel insert 110. For example, end 521 of puller rod 504 may screw into threads in thru-hole 306 of panel insert 110 (see FIG. 4). Alternatively, puller rod 504 may be inserted through the thru-hole 306 of panel insert 110 so that end 521 of puller rod 504 engages panel insert 110.

Biasing member 506 is configured to apply an axial force 530 to puller rod 504 (i.e., along axis 518) away from tool frame 502, and toward the other end 522 of puller rod 504. The axial force 530 is therefore away from the panel insert 110/panel 102. Biasing member 506 may comprise a spring (e.g., a coil spring) or another elastic member that stores potential energy when loaded (i.e., compressed or stretched), and applies an axial force 530 in the opposite direction with the potential energy. Biasing member 506 may be disposed between tool frame 502 and the other end 522 of puller rod 504 as shown in FIG. 5. However, biasing member 506 may be disposed at other positions in other embodiments. Biasing member 506 may mechanically couple with puller rod 504 at or near end 522, or at another position along a length of puller rod 504.

Heater 508 is configured to apply heat to panel insert 110. Heater 508 is positioned proximate to panel insert 110 so that heat generated by heater 508 acts to soften or melt the adhesive 420 used to bond panel insert 110 to panel 102. For example, heater 508 may contact panel insert 110, or may be positioned close to panel insert 110 to increase the temperature of panel insert 110 and/or the environment around panel insert 110. Heat transfer from heater 508 to panel insert 110 may be via conduction, convection, or radiation. Also shown is a heater controller 540 that controls the heat output of heater 508.

Removal tool 500 may include additional elements as desired. For example, removal tool 500 may include a loading member 510, which is configured to preload biasing member 506 by a predetermined amount. For example, loading member 510 may compress biasing member 506 by a predetermined amount to store potential energy. The potential energy in turn creates the axial force 530 applied by biasing member 506 to puller rod 504. In another embodiment, loading member 510 may stretch biasing member 506 by a predetermined amount to store potential energy.

Figure 6:
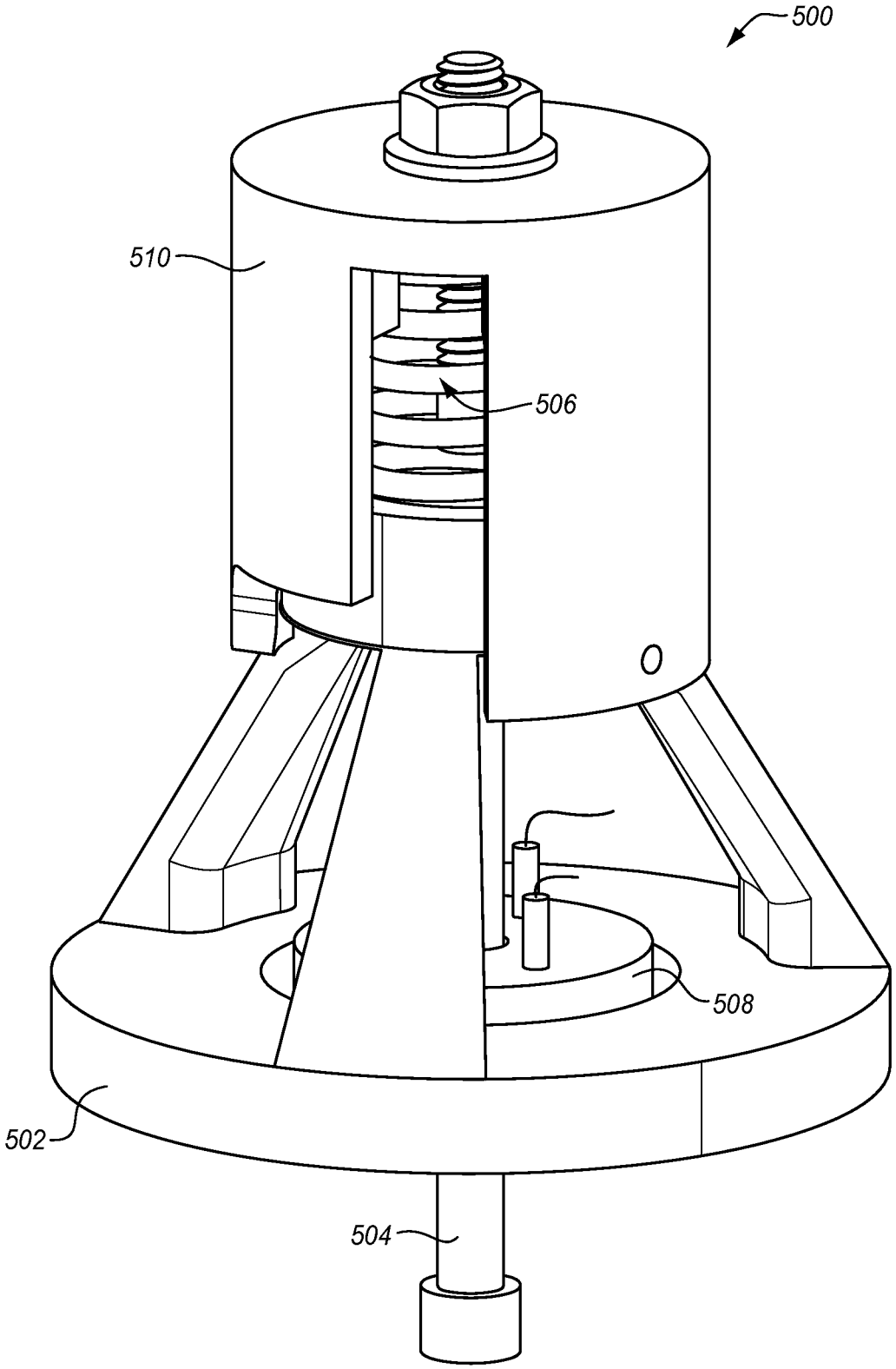
FIG. 6 is a perspective view of a removal tool in an illustrative embodiment.
Figure 7:
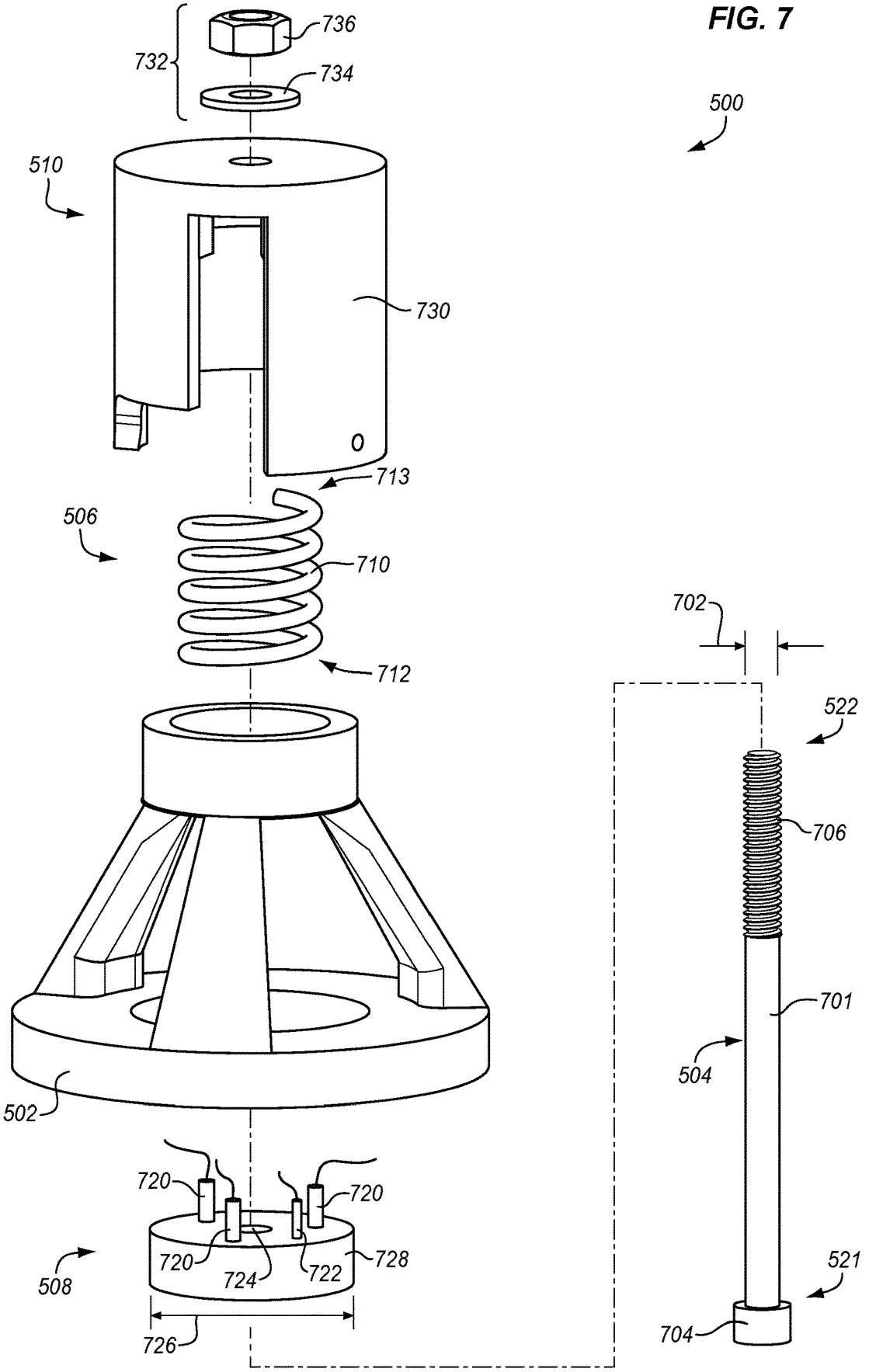
FIG. 7 is an exploded view of a removal tool in an illustrative embodiment.

FIGS. 6-12 show an example of removal tool 500 in one embodiment. FIG. 6 is a perspective view of removal tool 500 as assembled for extraction. As above, removal tool 500 includes tool frame 502, puller rod 504, biasing member 506, and heater 508. FIG. 7 is an exploded view of removal tool 500 in an illustrative embodiment. This view shows individual parts that make up removal tool 500 in one embodiment.

Figure 8:
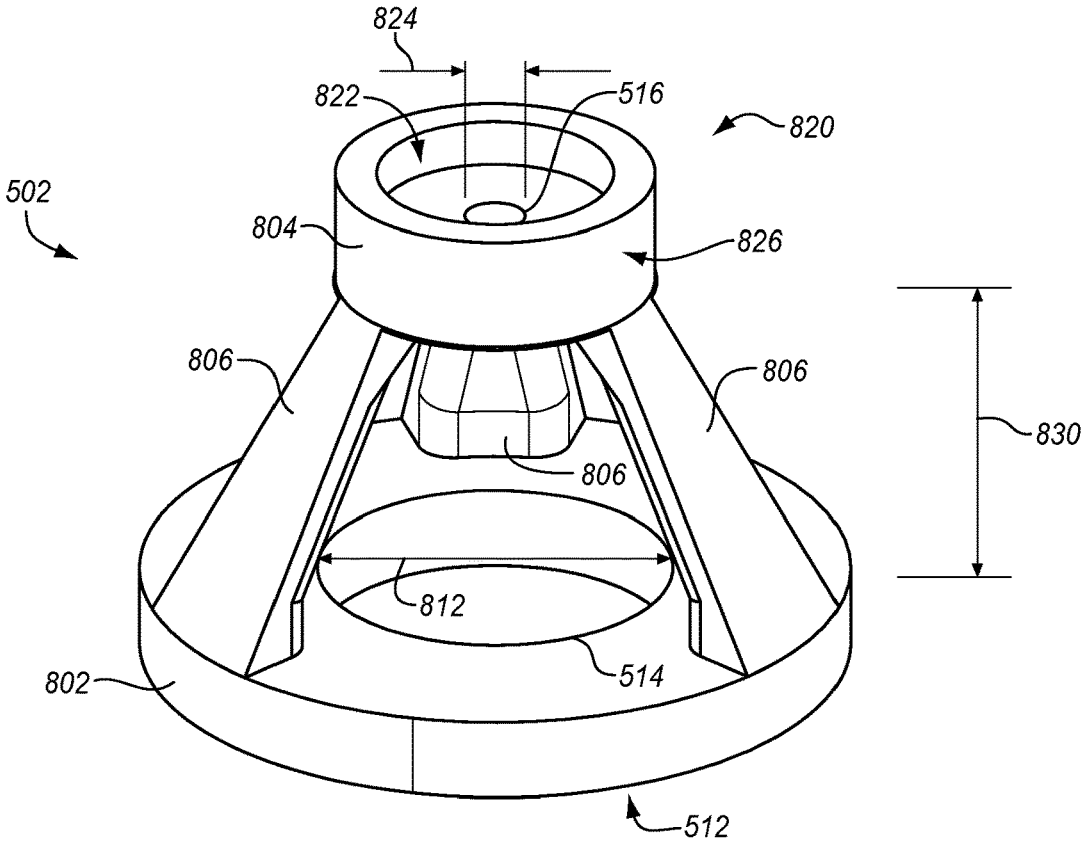
FIGS. 8-9 are perspective views of a tool frame in an illustrative embodiment.
Figure 9:
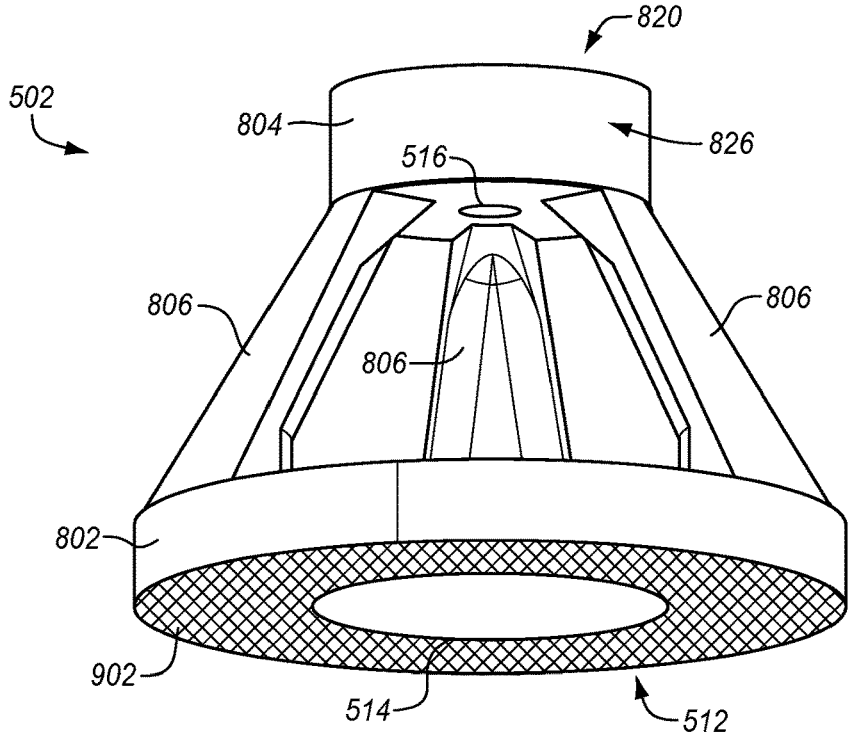

Tool frame 502 is a rigid structure that supports removal tool 500 on a panel 102. Tool frame 502 may be made from a plastic material, a metal material, or another type of rigid material. Tool frame 502 may be formed from an additive manufacturing process (e.g., 3D printing) or a subtractive manufacturing process as a monolithic part, or as an assembly of parts connected together. FIGS. 8-9 are perspective views of tool frame 502 in an illustrative embodiment. In this embodiment, tool frame 502 includes a base member 802, a seat member 804, and a plurality of legs 806 that extend between base member 802 and seat member 804. Base member 802 is shown as a generally annular body that includes an insert opening 514. When removal tool 500 is placed on a panel 102, insert opening 514 surrounds or encircles a panel insert 110 so that tool frame 502 straddles the panel insert 110. Insert opening 514 has a diameter 812 at least as large as the outer diameter 312 of the flange 304 (see FIG. 3). Base member 802 is the portion of tool frame 502 that comes into contact (directly or indirectly) with a panel 102. Thus, base member 802 defines the bottom surface 512 of tool frame 502. Bottom surface 512 has a contact area 902 (see FIG. 9) of sufficient size so that pressure or stress on a panel 102 is below a threshold. Although base member 802 is shown as being annular, the outer profile of base member 802 may vary as desired.

Seat member 804 is also shown as a generally annular body. The outer surface 826 of seat member 804 may be cylindrical as shown in FIG. 8. Seat member 804 is the portion of tool frame 502 that interfaces with biasing member 506. Thus, the structure of seat member 804 is such that it is configured to hold, restrain, or abut one end of biasing member 506. For example, the top side 820 of seat member 804 may include a recess 822 formed to hold one end of biasing member 506. Seat member 804 also includes the guide opening 516 of tool frame 502, which is coaxial with insert opening 514 of base member 802. Guide opening 516 is configured to direct the movement of puller rod 504 in the axial direction. Puller rod 504 is slidable in relation to tool frame 502, so guide opening 516 has a diameter 824 (slightly) larger than the diameter of puller rod 504. Although seat member 804 is shown as being annular, the outer surface 826 of seat member 804 may vary as desired.

Legs 806 are disposed between base member 802 and seat member 804 so that seat member 804 is separated from base member 802 by a distance 830. Legs 806 may be spaced (e.g., equally) radially around insert opening 514 of the base member 802. Although three legs 806 are shown for tool frame 502, there may be more or less legs 806 in other embodiments.

In FIG. 7, puller rod 504 may be an elongated cylindrical bar or shaft 701 having a diameter 702. The diameter 702 of puller rod 504 is less than the diameter of guide opening 516 in tool frame 502 (see FIG. 8) so that it is slidable in relation to tool frame 502. The diameter 702 of puller rod 504 may also be less than the diameter of thru-hole 306 in a panel insert 110 (see FIG. 3) so that puller rod 504 may be inserted through the panel insert 110. In one embodiment, puller rod 504 may have a head 704 at one end 521, and threads 706 at the other end 522 resembling a bolt. When inserted through a panel insert 110 (from the bottom side 105 of a panel 102), the head 704 of puller rod 504 contacts the bottom of the panel insert 110.

Biasing member 506 is shown as a spring 710 in this embodiment. Spring 710 is a compression spring that provides resistance to a compressive force applied axially. Spring 710 has opposing ends 712-713. Tool frame 502 (through seat member 804) is configured to engage end 712 of spring 710. Thus, seat member 804 may be referred to as a spring seat member. Although a spring 710 is shown in FIG. 7, biasing member 506 may comprise another type of elastic member in other embodiments.

Heater 508 may include a heater body 728, one or more heating elements 720, and a temperature sensor 722. In this embodiment, heater 508 is configured to fit within insert opening 514 of tool frame 502, and to encircle puller rod 504. Thus, heater body 728 is an annular body having a rod opening 724. Heater body 728 may be made from a material that conducts heat, such as Aluminum. When assembled, puller rod 504 is disposed through rod opening 724 of heater body 728. Thus, rod opening 724 has a diameter (slightly) larger than the diameter 702 of puller rod 504. Heater body 728 has an outer diameter 726 that is less than the diameter 812 of insert opening 514 of tool frame 502. The outer diameter 726 of heater body 728 may be equal to or greater than the diameter 312 of flange 304 of panel insert 110.

Heating elements 720 (or heating rods) are configured to generate heat in response to power from a power source. Although three heating elements 720 are shown, there may be more or less heating elements 720 in other embodiments. Temperature sensor 722 is configured to measure a temperature of heater 508 (i.e., heater body 728), and generate output indicating the temperature. For example, temperature sensor 722 may comprise a thermocouple or another type of sensor. Heater controller 540 (see FIG. 5) may be electrically connected to heating elements 720 and temperature sensor 722. Heater controller 540 is able to provide power to heating elements 720 to generate heat. Heater controller 540 also receives output from temperature sensor 722 indicating the temperature of heater body 728. There may be a temperature window where the adhesive 420 on a panel insert 110 softens or melts without degrading the properties of the panel 102 (e.g., 190-200 degrees F.). Thus, heater controller 540 is configured to monitor the temperature of heater 508, and selectively apply power to heating elements 720 based on the temperature output by temperature sensor 722 to keep heater 508 within the temperature window. One benefit is the heat applied to the panel insert 110 may be tightly controlled so that the panel 102 is not overheated and damaged.

Loading member 510 may include a housing 730 and a fastener 732. Fastener 732 is shown as a washer 734 and a nut 736 in this embodiment, but other types of fasteners are considered herein, such as a clamp, a cam lever, etc. Housing 730 is a rigid structure that at least partially surrounds spring 710, and is also configured to engage the other end 713 of spring 710. Thus, housing 730 may also be referred to as a spring housing. Housing 730 is also configured to engage puller rod 504, and is slidable or movable axially in relation to tool frame 502 as is puller rod 504. Housing 730 may be made from a plastic material, a metal material, or another type of rigid material. Housing 730 may be formed from an additive manufacturing process (e.g., 3D printing) or a subtractive manufacturing process as a monolithic part, or as an assembly of parts connected together.

Figure 10:
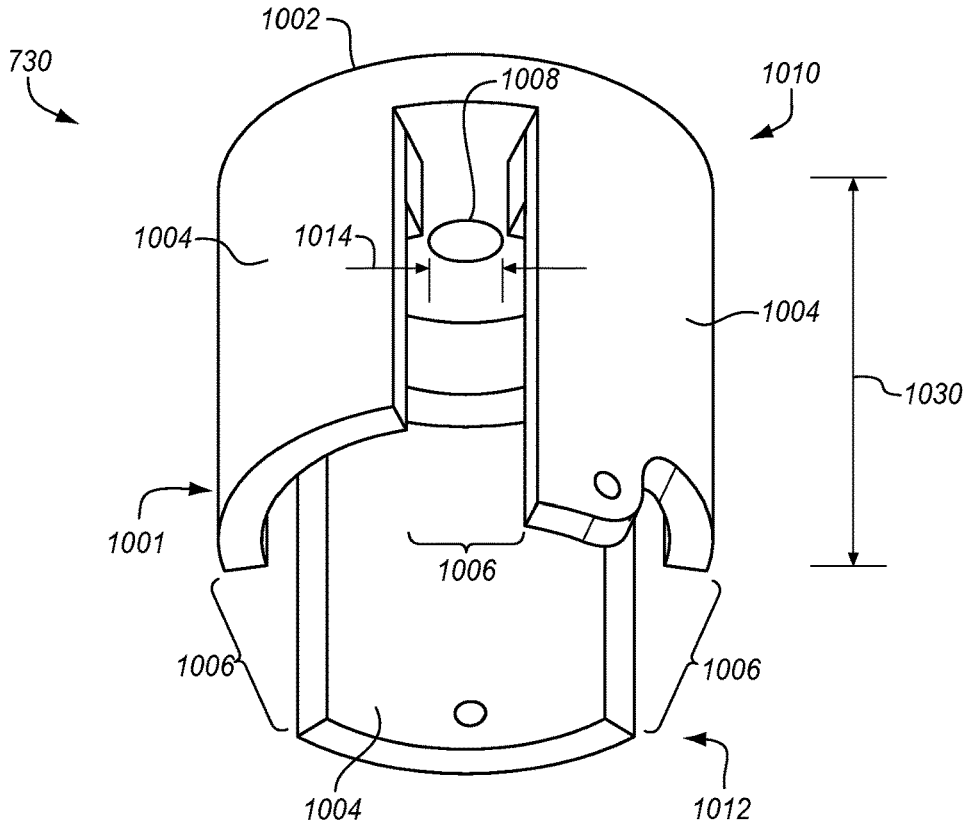
FIGS. 10-11 are perspective views of a housing in an illustrative embodiment.
Figure 11:
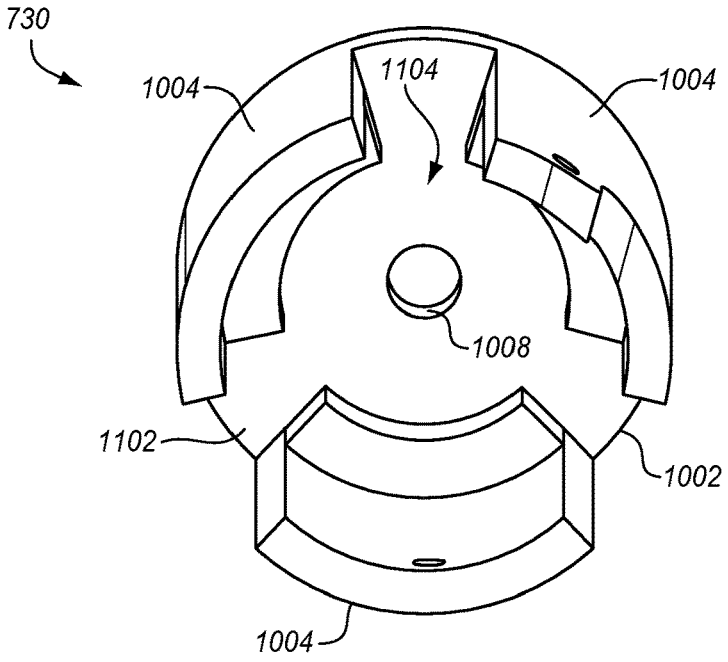

FIGS. 10-11 are perspective views of housing 730 in an illustrative embodiment. In FIG. 10, housing 730 is shown as a hollow, cylindrical body 1001 having an end wall 1002 at its top side 1010, and is open at its bottom side 1012. Housing 730 further includes a plurality of side walls 1004 that project (e.g., perpendicularly) from end wall 1002. Side walls 1004 are radially spaced about end wall 1002, and are separated by gaps 1006 that also extend perpendicularly to end wall 1002. Housing 730 is configured to move axially in relation to tool frame 502. Thus, gaps 1006 may align with legs 806 of tool frame 502 to allow side walls 1004 to move between the legs 806 of tool frame 502 (when spring 710 is compressed). Each side wall 1004 has a length 1030. As is visible in FIG. 10, the lengths 1030 of side walls 1004 may be different. The inner diameter of housing 730 is larger than the outer diameter of spring 710 and the outer diameter of seat member 804 so that housing 730 fits over spring 710 and seat member 804 when assembled as concentric members. Although housing 730 is shown as being cylindrical, the outer profile of housing 730 may vary as desired.

Housing 730 further includes a rod opening 1008 that is coaxial with guide opening 516 of tool frame 502 when assembled. Rod opening 1008 has a diameter 1014 (slightly) larger than the diameter of puller rod 504. Thus, housing 730 is slidable onto the puller rod 504 from end 522 via rod opening 1008 so that puller rod 504 may pass through rod opening 1008.

FIG. 11 is a view from the bottom side 1012 of housing 730. An inner surface 1102 of end wall 1002 includes a recess 1104 configured to hold or restrain end 713 of spring 710. As stated above, seat member 804 (see FIG. 8) of tool frame 502 holds one end 712 of spring 710, and the recess 1104 of housing 730 holds the other end 713 of spring 710. Thus, spring 710 may be compressed between tool frame 502 and housing 730.

Figure 12:
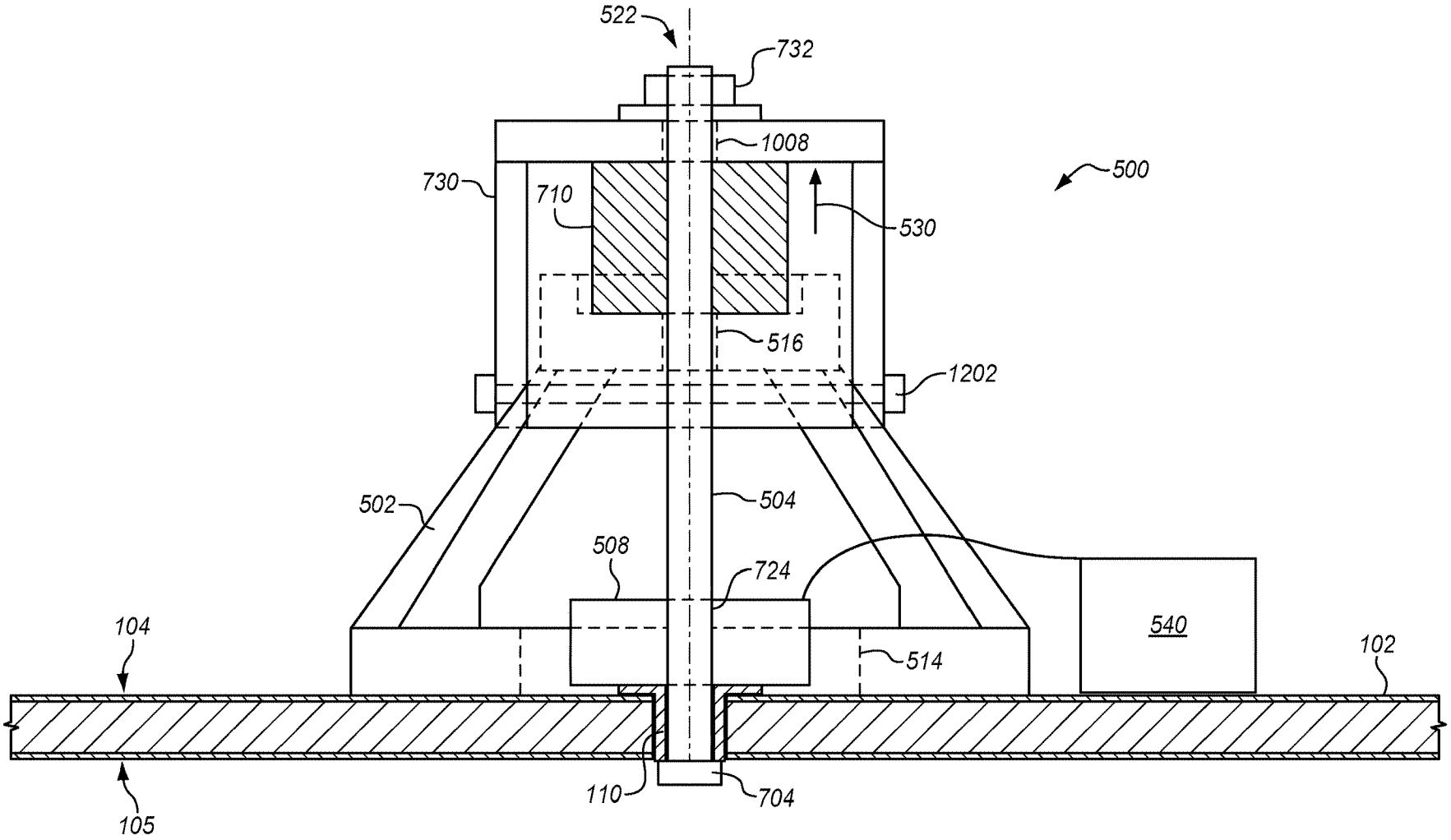
FIG. 12 is a cross-sectional view of a removal tool placed on a panel in an illustrative embodiment.

FIG. 12 is a cross-sectional view of removal tool 500 placed on a panel 102 in an illustrative embodiment. Removal tool 500 is placed on top side 104 of panel 102 to straddle the panel insert 110. Puller rod 504 is inserted through the panel insert 110 from the bottom side 105 of panel 102, through rod opening 724 in heater 508, through guide opening 516 of tool frame 502, through spring 710, and out rod opening 1008 of housing 730. When fully inserted, head 704 of puller rod 504 contacts the bottom end of panel insert 110. Fastener 732 is installed on the end 522 of puller rod 504, with housing 730 disposed between spring 710 and fastener 732. Fastener 732 may be tightened, which moves housing 730 axially toward tool frame 502 (downward in FIG. 12). This acts to compress spring 710 between tool frame 502 and housing 730. Fastener 732 may be tightened until spring 710 is preloaded by a predetermined amount (e.g., 40-50 lbs.). Due to its compression, spring 710 applies an axial force 530 on housing 730 and puller rod 504 in a direction away from tool frame 502 and away from panel 102 (upward in FIG. 12). Heater controller 540 controls heater 508 to apply heat to panel insert 110 while spring 710 applies the axial force 530 on puller rod 504 in a direction away from tool frame 502. When the heat from heater 508 softens or melts the adhesive 420, the axial force 530 on puller rod 504 is able to pull the panel insert 110 from the hole 402 in panel 102.

Figure 13:
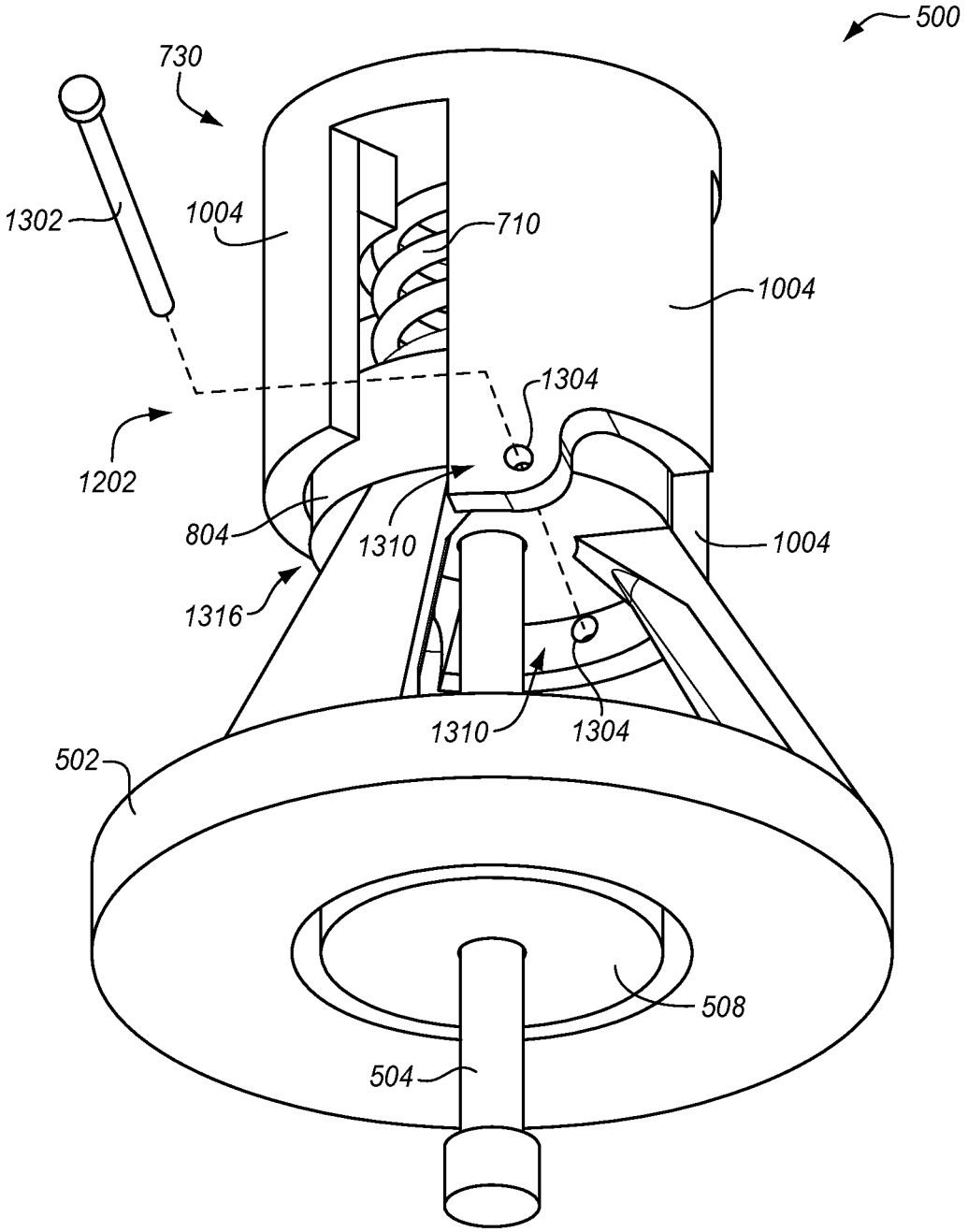
FIG. 13 is a perspective view of a removal tool with a stopper in an illustrative embodiment.

Removal tool 500 may further include a stopper 1202 that stops movement of housing 730 in the axial direction away from tool frame 502 due to the axial force 530 from spring 710 after traveling a threshold distance. When a panel insert 110 is extracted from a panel 102, it may tend to "pop" out of a hole 402 in a panel 102 instead of slowly extracting. Stopper 1202 is used to prevent housing 730, puller rod 504, spring 710, etc., from being cast upwardly or to come apart when the panel insert 110 is extracted. FIG. 13 is a perspective view of removal tool 500 with a stopper 1202 in an illustrative embodiment. In this embodiment, stopper 1202 is implemented with a securing pin 1302 and securing pin holes 1304 in housing 730. When spring 710 is compressed, a bottom portion 1310 of one or more of the side walls 1004 extends below the bottom side 1316 of seat member 804. Securing pin holes 1304 are formed in the bottom portion 1310 of a pair of the side walls 1004 so that the securing pin holes 1304 are coaxial. Securing pin 1302 may be inserted through securing pin holes 1304. With securing pin 1302 installed, housing 730 is restricted in how far it can travel in the axial direction away from tool frame 502. Thus, when a panel insert 110 is extracted from a panel 102, housing 730 is allowed to travel a threshold distance before securing pin 1302 makes contact with the bottom side 1316 of seat member 804.

Figure 14:
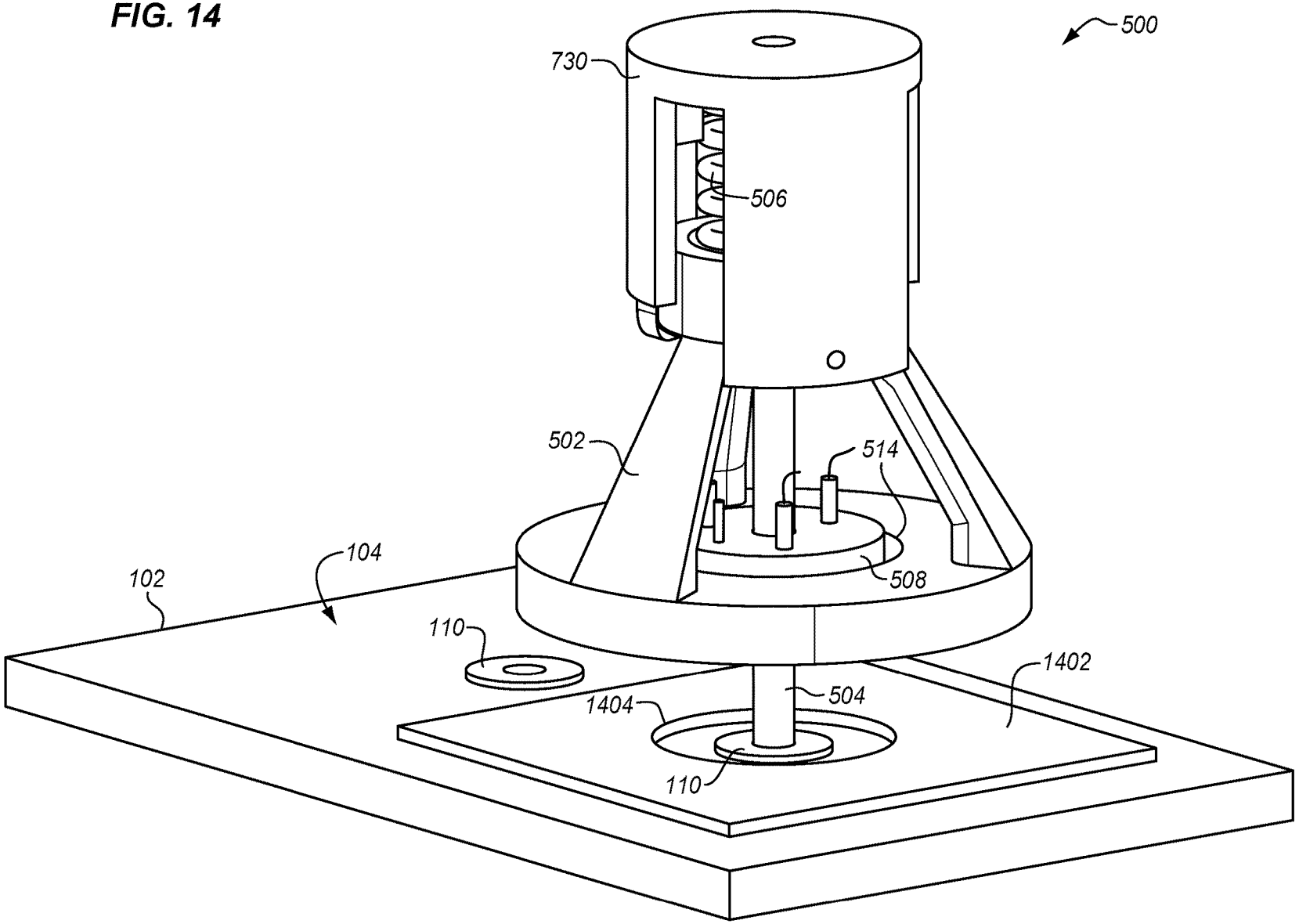
FIG. 14 is a perspective view of a removal tool with an insulation pad in an illustrative embodiment.

Additional features of removal tool 500 may include a part that protects a panel 102 from heat generated by heater 508. FIG. 14 is a perspective view of removal tool 500 with an insulation pad 1402 in an illustrative embodiment. Insulation pad 1402 is a flat sheet of insulation material, such as silicon. Insulation pad 1402 includes an insert opening 1404 that is aligned with insert opening 514 of tool frame 502, and may have a similar diameter as insert opening 514 of tool frame 502. Insulation pad 1402 is configured to be inserted between removal tool 500 and a side (e.g., top side 104) of panel 102. Insulation pad 1402 therefore acts to protect the top side 104 of panel 102 from heat generated by heater 508 when extracting a panel insert 110 from panel 102.

Figure 15:
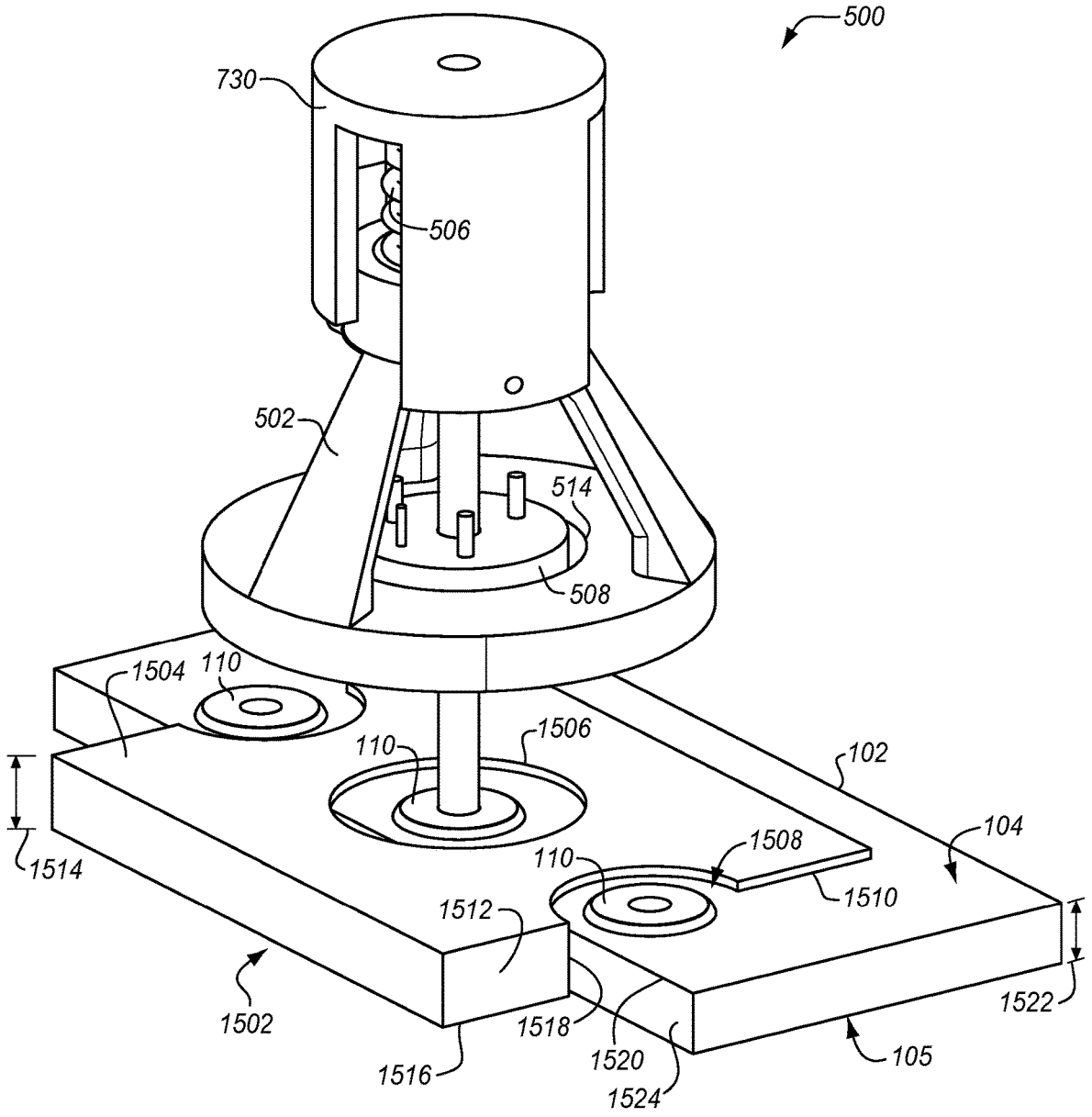
FIG. 15 is a perspective view of a removal tool with an edge adapter in an illustrative embodiment.

There may be situations where one or more panel inserts 110 are installed close to an edge of a panel 102. Thus, tool frame 502 may not be able to sit entirely on a surface of the panel 102 for extraction of a panel insert 110. Additional features of removal tool 500 may include an edge adapter that assists in extraction of panel insert 110 proximate to an edge of a panel 102. FIG. 15 is a perspective view of removal tool 500 with an edge adapter 1502 in an illustrative embodiment. In this example, panel inserts 110 are installed proximate to an edge 1520 of panel 102. Edge adapter 1502 has a top side 1504 that is generally flat to interface with bottom surface 512 of tool frame 502. Thus, tool frame 502 is able to rest (directly or indirectly) on top side 1504 of edge adapter 1502. Edge adapter 1502 further includes an insert opening 1506 that is aligned with insert opening 514 of tool frame 502, and may have a similar diameter as insert opening 514 of tool frame 502. The bottom side 1508 of edge adapter 1502 has a contact surface 1510 that is generally flat to rest (directly or indirectly) on the top side 104 of panel 102. The bottom side 1508 of edge adapter 1502 also has a spacer block 1512 that does not rest on the top side 104 of panel 102, and instead abuts an end 1524 of the panel 102. The thickness 1514 of spacer block 1512 corresponds with the thickness 1522 of panel 102 so that the bottom 1516 of spacer block 1512 rests on the same surface as the bottom side 105 of panel 102. An inward surface 1518 of spacer block 1512 is configured to contact the end 1524 of panel 102. Thus, inward surface 1518 of spacer block 1512 may be generally flat or may have a contour to match the end 1524 of panel 102. The transition from contact surface 1510 to inward surface 1518 generally forms a right angle to correspond with the edge 1520 of panel 102. Therefore, edge adapter 1502 may be positioned against edge 1520 of panel 102 with contact surface 1510 resting on the top side 104 of the panel 102, and inward surface 1518 contacting end 1524 of panel 102. Removal tool 500 may be placed on top side 1504 of edge adapter 1502 for extracting a panel insert 110. Because spacer block 1512 rests on the same surface as the bottom side 105 of panel 102, removal tool 500 may be oriented perpendicular to panel 102 for extraction.

Figure 16:
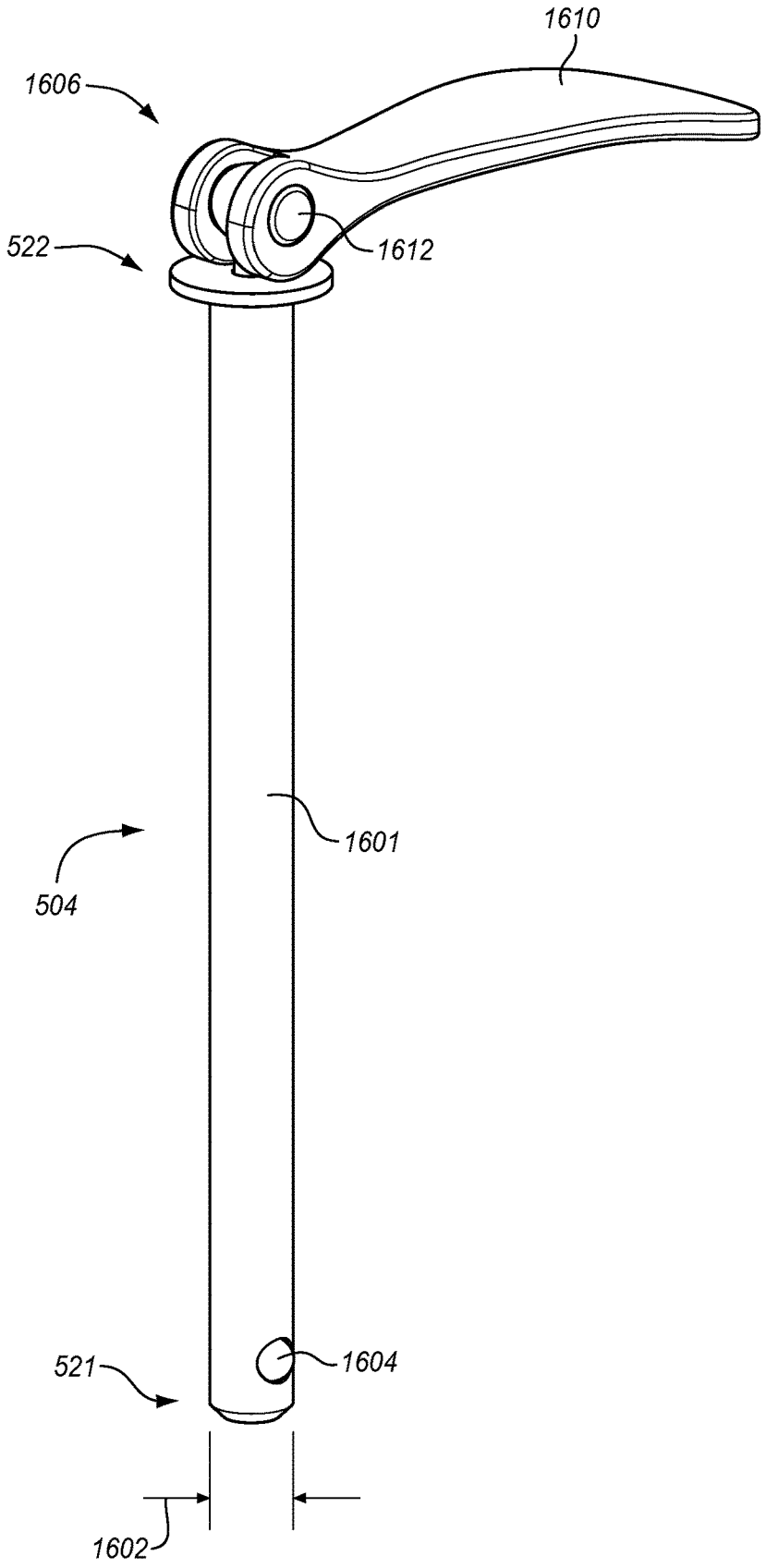
FIG. 16 is a perspective view of a puller rod in another illustrative embodiment.

The configuration of puller rod 504 as shown in FIG. 7 resembles a bolt. However, puller rod 504 may have other configurations in other embodiments. FIG. 16 is a perspective view of a puller rod 504 in another illustrative embodiment. Puller rod 504 may be an elongated cylindrical bar or shaft 1601 having a diameter 1602. The diameter 1602 of puller rod 504 is less than the diameter of guide opening 516 in tool frame 502 (see FIG. 8) so that it is slidable in relation to tool frame 502. The diameter 1602 of puller rod 504 may also be less than the diameter of thru-hole 306 in a panel insert 110 (see FIG. 3) so that puller rod 504 may be inserted through the panel insert 110. In one embodiment, puller rod 504 may have a ball lock 1604 at one end 521, and a cam lever 1606 at the other end 522. Ball lock 1604 includes at least one spring-loaded retaining ball that extends and retracts radially from shaft 1601. Cam lever 1606 includes a handle 1610 that is coupled to shaft 1601 via a hinge pin 1612. With this configuration, puller rod 504 may be inserted through a panel insert 110 (from the top side 104 of a panel 102). The force of pushing puller rod 504 through panel insert 110 causes ball lock 1604 to retract until end 521 of puller rod 504 extends through panel insert 110 and ball lock 1604 returns to its extended state. Puller rod 504 is then engaged with panel insert 110 via ball lock 1604. Handle 1610 of cam lever 1606 may then be rotated about hinge pin 1612 to activate the cam and achieve clamping. One technical benefit of this configuration is that puller rod 504 may be installed and removed quickly without the use of tools. Another technical benefit is that cam lever 1606 also acts as part of the loading member 510 for removal tool 500. Thus, the size or configuration of cam lever 1606 may be selected so that spring 710 is preloaded by a predetermined amount (e.g., 40-50 lbs.).

Figure 17:
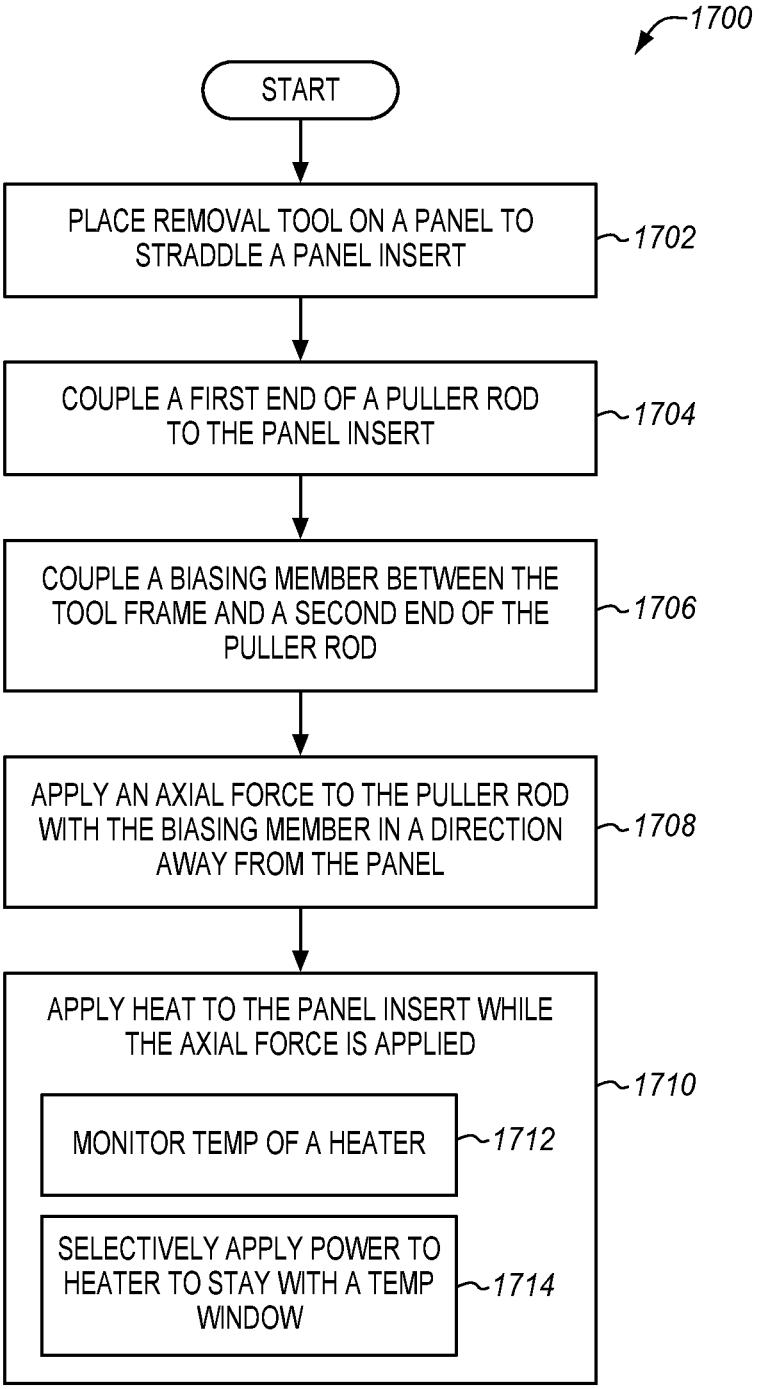
FIG. 17 is a flow chart illustrating a method of extracting a panel insert from a panel in an illustrative embodiment.

FIG. 17 is a flow chart illustrating a method 1700 of extracting a panel insert 110 from a panel 102 in an illustrative embodiment. The steps of method 1700 will be described with respect to the removal tool 500 as described above, although one skilled in the art will understand that the methods described herein may be performed with other types of tools. The steps of the methods described herein are not all inclusive and may include other steps not shown. The steps for the flow charts shown herein may also be performed in an alternative order.

It is assumed for method 1700 that a panel insert 110 is installed in a panel 102 and bonded to the panel 102 as illustrated in FIG. 4. Removal tool 500 is placed on the panel 102 so that tool frame 502 straddles the panel insert 110 (step 1702). With the tool frame 502 situated over the panel insert 110, one end 521 of puller rod 504 is coupled, engaged, attached, or connected to the panel insert 110 (step 1704). For example, puller rod 504 may be inserted through the thru-hole 306 in panel insert 110 from its bottom until a head 704 at end 521 of the puller rod 504 contacts the bottom of the panel insert 110 (see FIG. 7). In another example, puller rod 504 may be inserted through the thru-hole 306 in panel insert 110 from the top side 104 of panel 102 to retract the ball lock 1604, and is pressed through panel insert 110 until end 521 of puller rod 504 extends through panel insert 110 and ball lock 1604 returns to its extended state (see FIG. 16).

Puller rod 504 is configured in removal tool 500 to pull the panel insert 110 generally perpendicular to the top side 104 of the panel 102. Thus, a biasing member 506 (e.g., spring 710) is coupled between tool frame 502 and the other end 522 of puller rod 504 (step 1706). Biasing member 506 applies an axial force 530 to puller rod 504 in a direction away from the panel 102 (step 1708). A heater 508 also applies heat to the panel insert 110 (step 1710) while the axial force 530 is applied by biasing member 506. For example, heater controller 540 may monitor a temperature of heater 508 (step 1712), and selectively apply power to heater 508 to stay within a temperature window (step 1714). When the heat softens or melts the adhesive 420 to a certain point, the axial force 530 will overcome the bond formed by the adhesive 420, and extract the panel insert 110 from the panel 102. The extracted panel insert 110 is removed from puller rod 504, and removal tool 500 may be moved to another panel insert 110 on the panel 102. Method 1700 may be repeated for a number of panel inserts 110.

One benefit of method 1700 is that it is an automated process for applying consistent force and controlled heat to remove panel inserts 110 from a panel 102. Method 1700 is less likely to damage the panel 102 when extracting a panel insert 110, and is easily repeatable by operators without need for specialized skills.

Any of the various elements shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope is not limited to those specific embodiments. Rather, the scope is defined by the following claims and any equivalents thereof.

The invention claimed is:

1. A removal tool comprising:

a tool frame to straddle a panel insert installed in a panel;

a puller rod slidably disposed through the tool frame perpendicularly to a bottom surface of the tool frame that contacts the panel, wherein the puller rod has a first end to engage the panel insert;

a biasing member that applies an axial force to the puller rod away from the tool frame; and a heater to apply heat to the panel insert.

2. The removal tool of claim 1 wherein:

the biasing member is disposed between the tool frame and a second end of the puller rod.

3. The removal tool of claim 1 further comprising:

a loading member that preloads the biasing member by a predetermined amount.

4. The removal tool of claim 1 wherein the heater includes:

one or more heating elements; and a temperature sensor that measures a temperature.

5. The removal tool of claim 4 further comprising:

a heater controller electrically coupled to the heating elements and the temperature sensor;

wherein the heater controller selectively applies power to the heating elements based on the temperature output by the temperature sensor.

6. A removal tool comprising:

a tool frame that supports the removal tool on a side of a panel, and straddles a panel insert installed in the panel;

a puller rod that extends through a guide opening in the tool frame and is slidable axially in relation to the tool frame, the puller rod having a first end to couple with the panel insert;

a housing having a rod opening coaxial with the guide opening in the tool frame, wherein the puller rod extends through the rod opening, and the housing is coupled to the puller rod toward a second end of the puller rod;

a spring disposed between the tool frame and the housing that applies an axial force against the housing; and a heater to apply heat to the panel insert.

7. The removal tool of claim 6 wherein the tool frame includes:

a base member defining a bottom surface of the tool frame that contacts the side of the panel, and having an insert opening to encircle the panel insert;

a seat member having the guide opening of the tool frame that is coaxial with the insert opening of the base member; and a plurality of legs disposed between the base member and the seat member;

wherein the puller rod passes through the insert opening and the guide opening;

wherein the seat member holds a first end of the spring.

8. The removal tool of claim 7 wherein the housing includes:

a hollow, cylindrical body comprising:

an end wall having the rod opening coaxial with the guide opening of the seat member; and a plurality of side walls that project from the end wall with gaps separating the side walls;

wherein an inner surface of the end wall holds a second end of the spring.

9. The removal tool of claim 8 wherein:

the legs of the tool frame are spaced radially around the insert opening of the base member; and the side walls of the housing are disposed between the legs when the spring is compressed.

10. The removal tool of claim 8 further comprising:

a stopper that stops axial movement of the housing away from the tool frame due to the axial force from the spring after traveling a threshold distance.

11. The removal tool of claim 10 wherein:

when the spring is compressed, a bottom portion of a pair of the side walls extend below the seat member of the tool frame; and the stopper includes a securing pin inserted through coaxial holes in the bottom portion of the pair of the side walls.

12. The removal tool of claim 6 wherein the heater includes:

a heater body having a rod opening, wherein the puller rod passes through the rod opening;

one or more heating elements; and a temperature sensor that measures a temperature of the heater body.

13. The removal tool of claim 12 wherein:

an outer diameter of the heater body is equal to or greater than a diameter of the panel insert.

14. The removal tool of claim 12 further comprising:

a heater controller electrically coupled to the heating elements and the temperature sensor;

wherein the heater controller selectively applies power to the heating elements based on the temperature output by the temperature sensor.

15. The removal tool of claim 6 wherein the puller rod comprises:

an elongated cylindrical shaft having a head at the first end, and threads at the second end;

wherein a diameter of the puller rod is less than a diameter of a thru-hole in the panel insert;

wherein a fastener is threaded on the second end with the housing disposed between the spring and the fastener.

16. The removal tool of claim 6 wherein the puller rod comprises:

an elongated cylindrical shaft having a ball lock at the first end, and a cam lever at the second end;

wherein a diameter of the puller rod is less than a diameter of a thru-hole in the panel insert.

17. The removal tool of claim 6 further comprising:

an insulation pad between the tool frame and the panel;

wherein the insulation pad includes an insert opening aligned with an insert opening of the tool frame.

18. The removal tool of claim 6 further comprising:

an edge adapter having:

a top side that interfaces with a bottom surface of the tool frame;

a bottom side that includes a contact surface to rest on the panel, and a spacer block having a thickness that corresponds with a thickness of the panel; and an insert opening aligned with an insert opening of the tool frame.

19. A method of extracting a panel insert from a panel, the method comprising:

placing a removal tool on the panel so that a tool frame of the removal tool straddles the panel insert;

coupling a first end of a puller rod to the panel insert;

coupling a biasing member between the tool frame and a second end of the puller rod;

applying an axial force to the puller rod with the biasing member in a direction away from the panel; and applying heat to the panel insert while the axial force is applied by the biasing member to extract the panel insert from the panel.

20. The method of claim 19 wherein applying the heat comprises:

monitoring a temperature of a heater; and selectively applying power to the heater to stay within a temperature window.

* * * * *